US005366308A

United States Patent [19]

Crispino

[11] Patent Number: 5,366,308

[45] Date of Patent: Nov. 22, 1994

[54] HOT ASPHALT TRANSFER AND APPLICATION DEVICE

[76] Inventor: Louis T. Crispino, 2215 Cross Country Blvd., Baltimore, Md. 21209

[21] Appl. No.: 74,623

[22] Filed: Jun. 11, 1993

[51] Int. Cl.[5] ..... B05B 1/24; B05C 17/035

[52] U.S. Cl. ..... 401/1; 126/343.5 A; 239/130; 392/447; 401/2; 401/48; 401/219

[58] Field of Search ..... 401/1, 2, 48, 219; 239/130; 126/343.5 A; 392/447

[56] References Cited

U.S. PATENT DOCUMENTS

| | | | |
|---|---|---|---|
| 1,751,565 | 3/1930 | Talbott | 401/2 |
| 3,853,410 | 12/1974 | Busoni | 401/1 |
| 4,028,527 | 6/1977 | Thagard, Jr. | 219/311 |
| 4,059,258 | 11/1977 | Arai | 401/217 |
| 4,159,877 | 7/1979 | Jacobson et al. | 366/22 |
| 4,165,192 | 8/1979 | Mellen | 401/48 |
| 4,245,785 | 1/1981 | Johansing, Jr. | 239/112 |
| 4,344,571 | 8/1982 | Kundig | 239/130 |
| 4,960,242 | 10/1990 | Larson | 239/168 |

FOREIGN PATENT DOCUMENTS

| | | | |
|---|---|---|---|
| 606980 | 4/1978 | U.S.S.R. | 401/1 |

*Primary Examiner*—Steven A. Bratlie
*Attorney, Agent, or Firm*—Walter G. Finch

[57] ABSTRACT

The present invention provides a machine for automating the transferral and application of hot asphalt material to roof surfaces. The machine includes a number of reels attached to an outer shell contained on a cart. Each reel contains roughly five-hundred feet of hose and attaches to one of two types of hand-held applicator devices. An electric generator, a storage tank assembly, and a pump assembly are contained within the outer shell. The combination of heating elements disposed within the storage tank and heating wires wrapped around the inner tube members of the hoses keeps the asphalt material in a liquified form during operation of the device. Compared to other conventional methods and apparatus, the present device greatly enhances the safety and efficiency associated with hot asphalt roofing.

20 Claims, 13 Drawing Sheets

HOT ASPHALT TRANSFER AND APPLICATION DEVICE

BACKGROUND AND PRIOR ART OF THE INVENTION

This invention relates to roofing construction, and is more particularly concerned with the transfer and application of molten asphaltic material to roofs. The invention provides an apparatus which replaces conventional methods of transferring asphaltic compositions to elevated work areas with an automatic feed system. In addition, uniform application of the asphaltic material to work surfaces is achieved via a number of hand-operable, attachable applicator devices.

In building or repairing a structure, it is conventional practice to coat a roof surface with a liquid roofing composition. This liquid roofing composition may include a mixture of tar, pitch, and bituminous components. For simplicity, this roofing composition will heretofore be referred to as 'hot asphalt' when it is in a heated, liquified form.

Traditional practice has been to heat a central supply of this roofing composition in a kettle or tanker located on the ground. When the roofing composition reaches temperatures in excess of 300° F., it changes into a hot asphalt state. One type of heating device used to warm roofing material is described in the Mason U.S. Pat. No. 5.099,824, in which water hearted by a natural gas source is allowed to circulate around drunks containing said roofing material. Another similar apparatus is disclosed in the U.S. Pat. No. 5,120,2,17 issued to O'Brien et al. This particular asphalt heating device, which includes a conveyor means in the form of a screw discharge feed, heats initially cold asphaltic material to a temperature between 275° and 300° F., and maintains it at that temperature until it is used. The slow and even heating operation proposed by the O'Brien et al. invention avoids overheating, segregation, oxidation, or ignition of the asphaltic material.

Transferal of the hot asphalt to the elevated roof surfaces has relied, in large part, on labor intensive techniques and apparatus. If the working surface area of the roof to be coated is relatively small, quantities of the hot asphalt are manually carried up steps or ladders to hot luggers. The hot asphalt is then poured into individual mop carts or spreaders, and subsequently applied to the roof surfaces. Alternatively, if the area of the roof is relatively large, crude pump mechanisms are routinely employed to automatically transfer the hot asphalt from the ground based kettle to a hot lugger on the roof.

These conventional transfer practices have led to numerous problems. The first, and possibly the most evident, is one of inefficiency. If only a few workers are engaged in a typical roofing operation, they will have to alternate between applying the hot asphalt material to the roof surface and transferring the same from the ground to a place of easy access. Since the major portion of the hot asphalt material must remain on the ground to be heated in the central kettle or tanker during an application, this back and forth routine can ultimately turn a seemingly small roofing job into a tedious and tinge consuming operation. In order to allow such a roofing application to become a more continuous and non-interrupted process, quantities of the hot asphalt will need to be regularly transferred to the roof top at small tinge intervals. As conventional methods dictate, this can only be accomplished with the addition of more laborers.

Still another drawback associated with these conventional hot asphalt transfer practices is one of safety. Since the hot asphalt material can reach temperatures starting from 275° F. and exceeding 500° F., direct contact with the material often results in first to third degree burns. Manually carrying the hot asphalt up ladders to roof surfaces is an exceptionally dangerous technique, and one which has resulted in serious injuries to scores of laborers. Once the molten material is on the roof surface, danger of contact with and exposure to the hot asphalt continues as it is dumped into hot luggers, poured into mop carts, and finally, applied to roof surfaces.

Once the hot asphalt has been transferred to a readily accessible place, the roof workers must apply the hot asphalt to the roof surface. The primary object in this stage is to apply a sufficient and uniform coat of the material onto the surface. If too little hot asphalt is applied at certain points, those same inadequately coated areas may become vulnerable to leaking as the roof ages. If too much hot asphalt is applied, both tinge and material are wasted. Also, since the hot asphalt is subject to 'setting-up' when it is out of communication with a heat source (especially in cold weather conditions), the roofers are typically forced to apply the material rather speedily. An old but nonetheless acceptable technique in this application stage is to first clip mops into mop buckets containing the hot asphalt material, and then to manually spread the material in a mopping-like manner. Another technique is to dump a quantity of hot asphalt material directly onto the roof surface, and to then spread it using a combination of mops, rakes, and float devices.

In his two U.S. Pat. Nos. 4,165,192 and 4,265,559, Mellen introduces a novel hot asphalt spreading machine (improved in his second patent) which assists in this application process. The spreading apparatus includes an insulated chamber for containing an amount of hot asphalt, a pipe system extending from the insulated chamber and having a number of port holes for regulating the flow of the hot asphalt from the container, and a turnable valve and valve control handle for actuating and controlling the hot asphalt flow. Once the hot asphalt is ejected from the port holes located along the pipe system, it is evenly spread by either teasing chains or screens, and finally, by a trailing rake. These spreading tools are all dragged immediately behind the path of newly ejected hot asphalt material.

Although the Mellen spreading machine does make the application of the hot asphalt a more controlled and simplified process, his machine has several shortcomings. First, there is no provision for or suggestion of a feed system which would automatically transfer the hot asphalt to the spreading device. Instead, his machine needs to be manually refilled every tinge the insulated chamber is emptied. Even when compared to traditional techniques, this is rather time consuming. Second, the insulated chamber in his machine can only keep the hot asphalt in a liquid state for a certain amount of time. In this sense, a delay in the application process will cause the hot asphalt in the container to harden, and coating will become difficult if not in, possible. In order to avoid these problems, the hot asphalt will still need to be applied relatively quickly, especially during winter applications. Also, since the hot asphalt needs to be manually poured into the insulated chamber through a funnel opening, danger of exposure to the molten material does still exist.

A number of hand-held devices used to apply heated substances have not only been invented, but are also thoroughly accounted for in the prior art. The U.S. Pat. No. 1,491,459 issued to Bernat teaches a hand-held brush device used to supply garments with steam in a continuous and thin stream. The Bernat steam brush includes an insulated hand grip that allows the user to comfortably manipulate the device without danger of being burned. A molten material dispenser used to heat and apply molten wax for the creation of pattern molds is the subject of the Ghim U.S. Pat. No. 4,432,715. The Ghim invention includes a storage container for the wax, means to heat the wax, means to control the wax flow, and means to transfer the wax between the storage container and an applicator portion.

Since the Bernat and Ghim inventions are respectively directed towards spraying steam onto fabrics and applying wax to molds, they are not capable of transferring and applying hot asphalt material. Neither have discharge ports designed to spray hot asphalt. Moreover, the small size of the Ghim device renders it completely impractical for large scale roofing applications.

What is needed is a portable device which can automate the transfer of a steady supply of the hot asphalt material to a roof surface, keep the hot asphalt supply heated so that it remains in a readily spreadable form, and automatically transfer the hot asphalt material to any one of a number of hand-held applicators. Such a device would greatly improve both the efficiency and safety associated with conventional roofing practices.

OBJECTS OF THE INVENTION

It is an object of this invention to provide a novel hot asphalt transfer and application device for use in the rooting industry.

Another object of this invention is to provide a hot asphalt machine having a heated storage chamber for the molten material, hydraulic pump means for circulating the molten asphalt, and a generator for supplying power to heat the storage chamber and drive the hydraulic pump means.

Yet another object of this invention is to provide a molten asphalt roofing machine having a heated storage chamber complete with an automatic level control mechanism in order to regulate the amount of hot asphalt therein contained.

Still another object of this invention is to provide a unique and novel hot asphalt device having a plurality of independent sets of heated and insulated Teflon tube means, one of which leading to a central supply source and all others leading to a number of hand-held hot asphalt applicators.

To provide a novel asphalt transfer and application machine which constantly communicates with a central hot asphalt supply so as to automatically maintain a sufficient quantity of spreadable asphalt is another object of this invention.

To provide a hot asphalt machine which may be placed on a roof surface to assist workers in their duties is yet another object of this invention.

And to provide a novel hot asphalt machine that will reduce the amount of danger of hot asphalt exposure and, at the same time, increase the productivity and efficiency of the overall asphalt transfer and coating process is still another object of this invention.

BRIEF DESCRIPTION OF THE DRAWINGS

These and other objects and attendant advantages of this invention will become more obvious and understood from the following detailed specification and accompanying drawings, in which.

DESCRIPTION OF THE PREFERRED EMBODIMENT OF THE INVENTION

Figure 1:
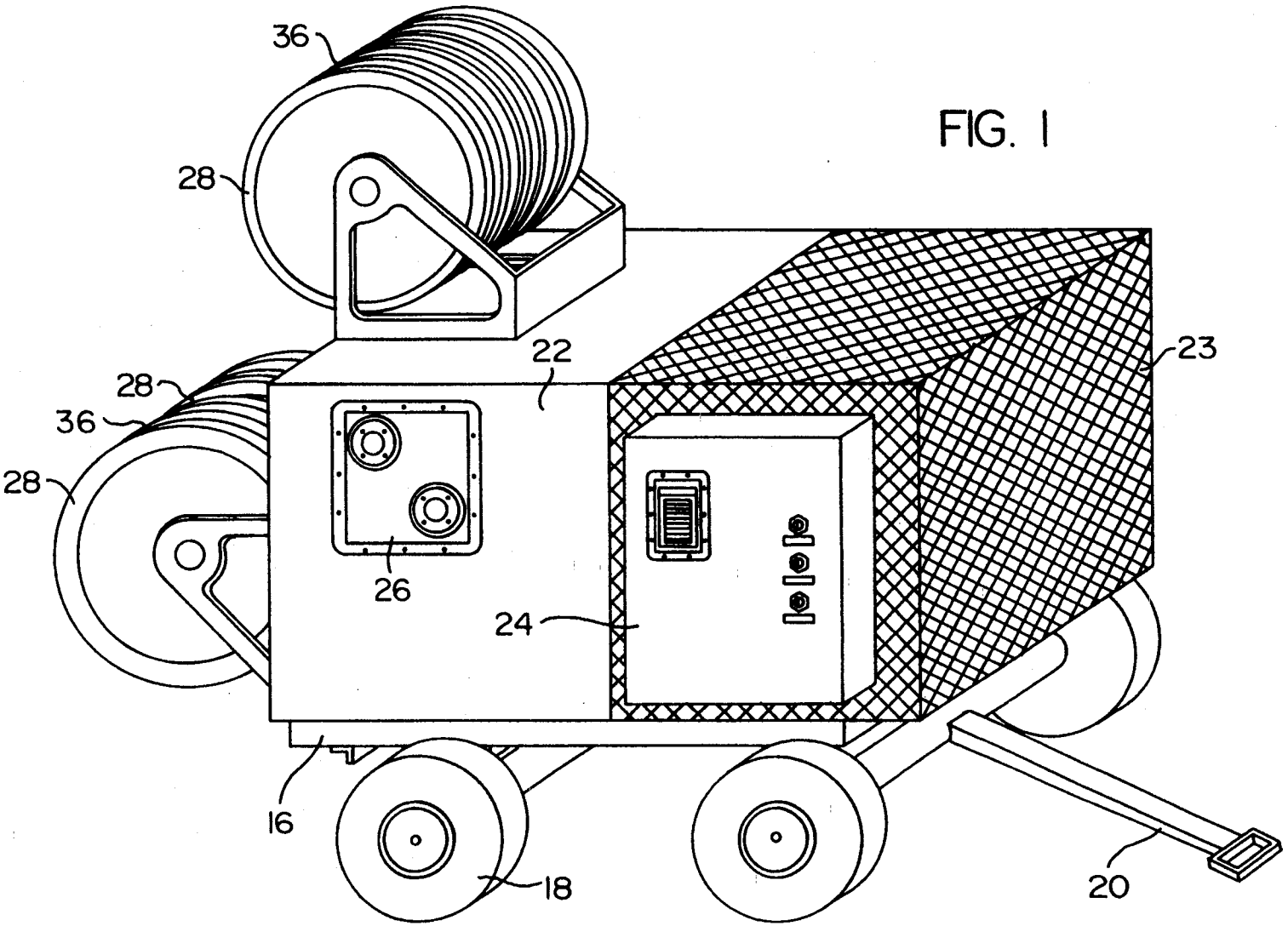
FIG. 1 is a perspective view of a hot asphalt transfer and application device, incorporating novel features and embodiments of this invention.

Referring now to FIGS. 1 to 13 of the drawings, there is shown the preferred embodiment of a hot asphalt transfer and application device. FIG. 1 presents the hot asphalt device in perspective view, clearly illustrating the overall shape of the machine. The upper portion of the device rests on a deck plate 19 attached to a cart 16 having four wheels 18 and a pulling bar 20. Since the net weight of the hot asphalt device will range from approximately one thousand to fifteen hundred pounds, the cart 16 will need to be constructed from a relatively thick gauge metal and may include more wheels 18.

Figure 2:
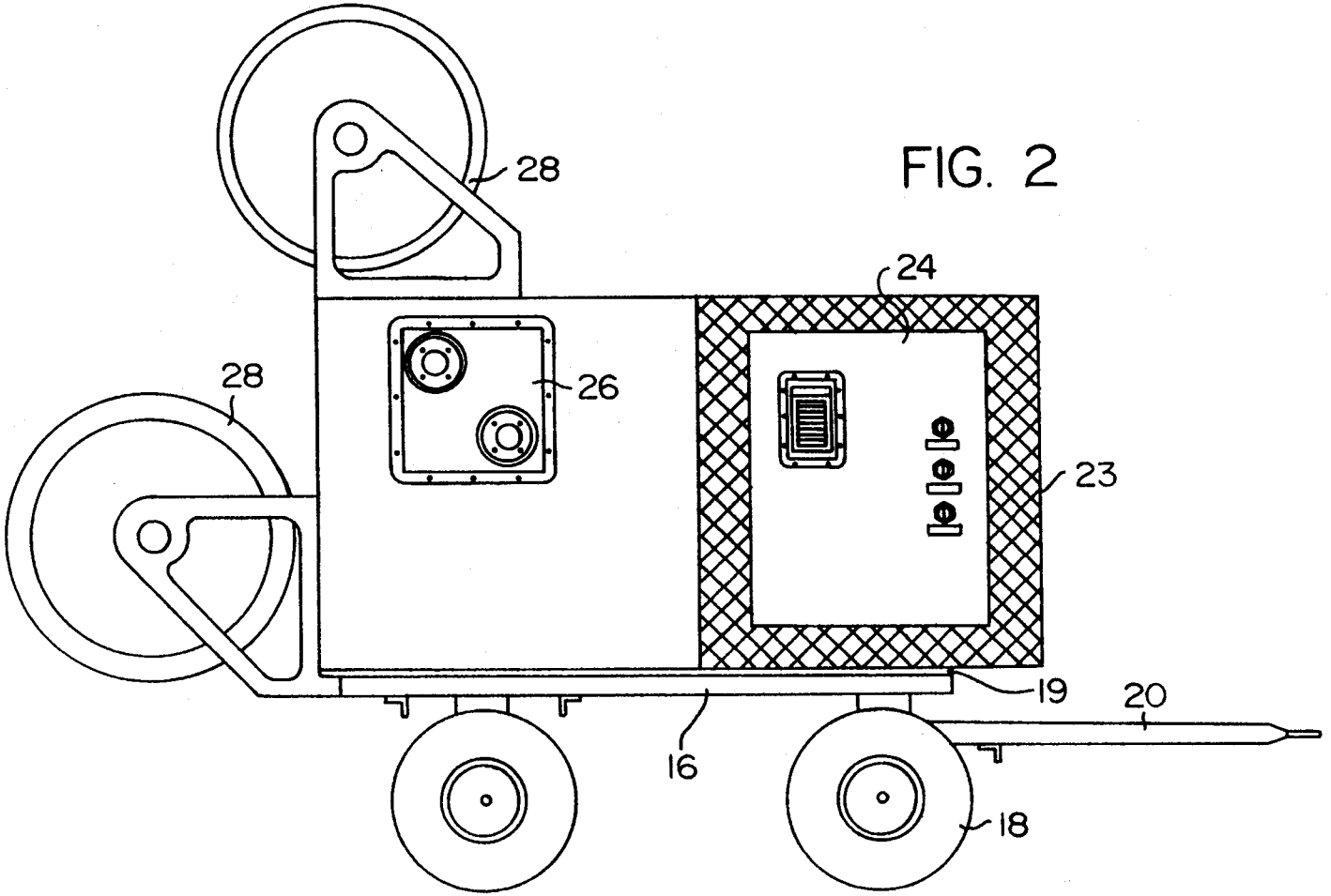
FIG. 2 is a fight side elevation of the device of FIG. 1.

As seen in FIGS. 1 and 2, the upper portion of the device includes an outer shell 22 which is essentially rectangular in shape. The front portion of the outer shell 22 is a diamond screen vent 23 for circulating air in and out of the interior of the device. Attached to the outer shell 22 at the rear end of the device are three reel mechanisms 28, each independently supporting roughly five hundred feet of pliable hose 36. As seen in the figures, one reel mechanism 28 is attached to the top of the device on the outer shell 22, while the other two are joined adjacent one another on the back face of the device. The left face of the hot asphalt device includes a control panel 24 and a storage tank manifold 26.

Figure 3:
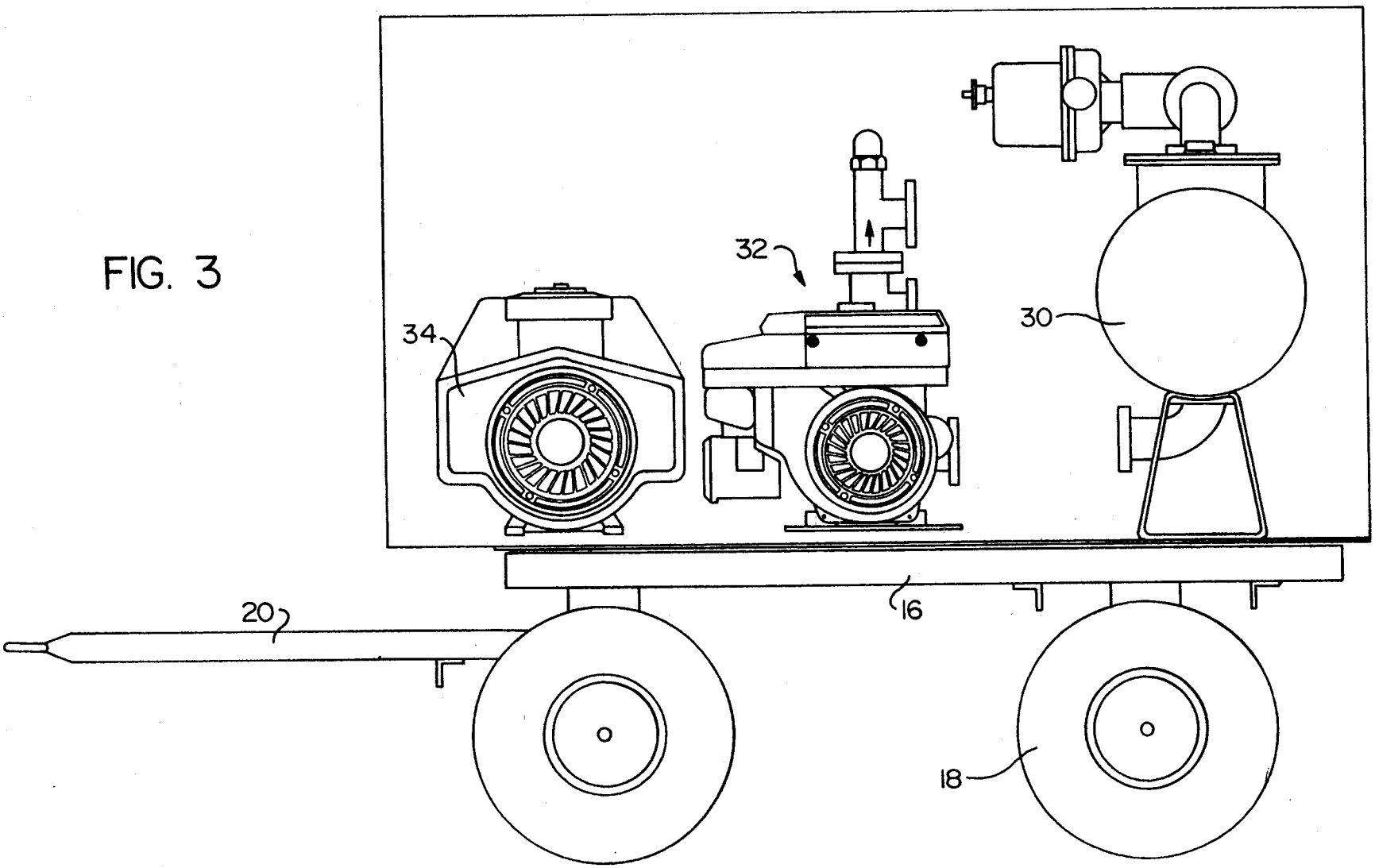
FIG. 3 is an enlarged left side elevation showing the interior of the device of FIG. 1, the left face of the outer shell and all hose reels having been removed.
Figure 4B:
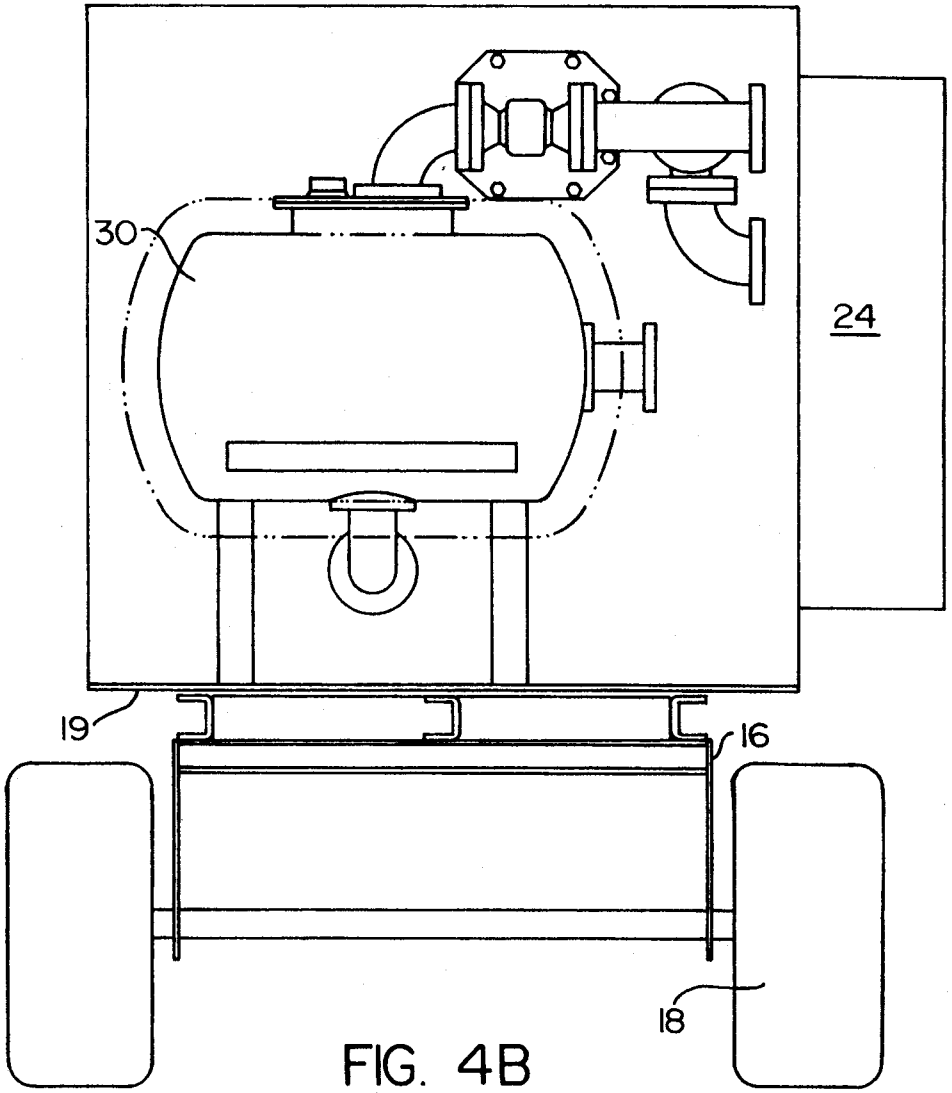
FIG. 4B is an enlarged rear elevation showing the interior of the device of FIG. 1, the rear face of the outer shell and all hose reels having been removed.
Figure 4A:
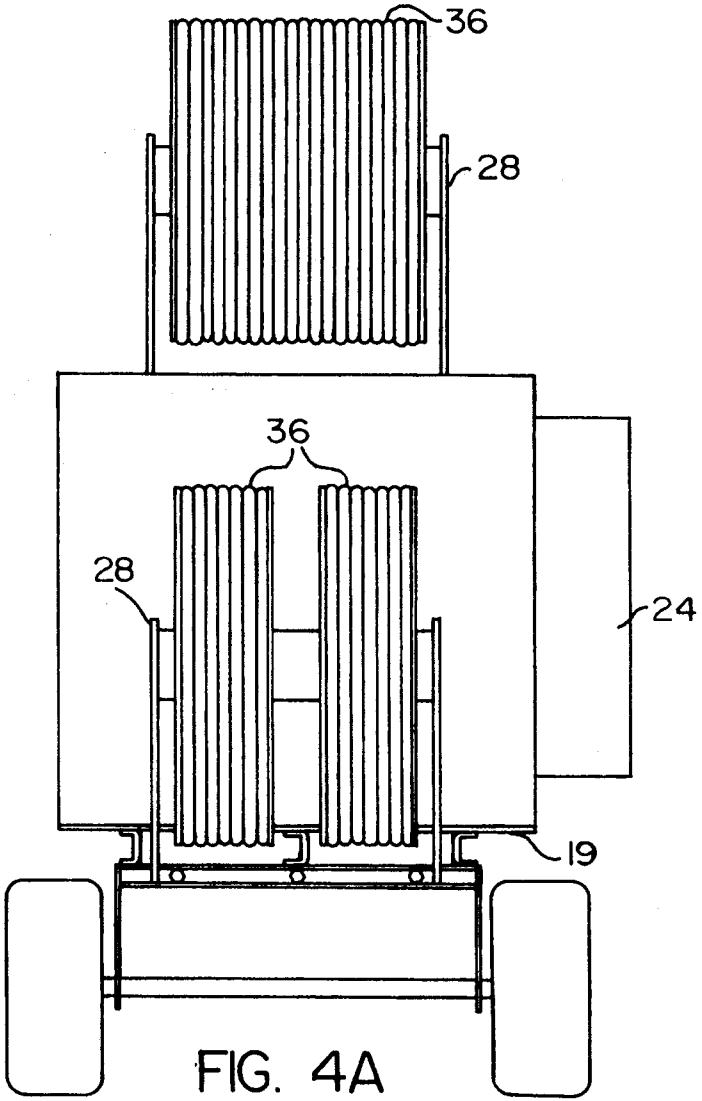
FIG. 4A is a rear elevation of the device of FIG. 1.
Figure 5:
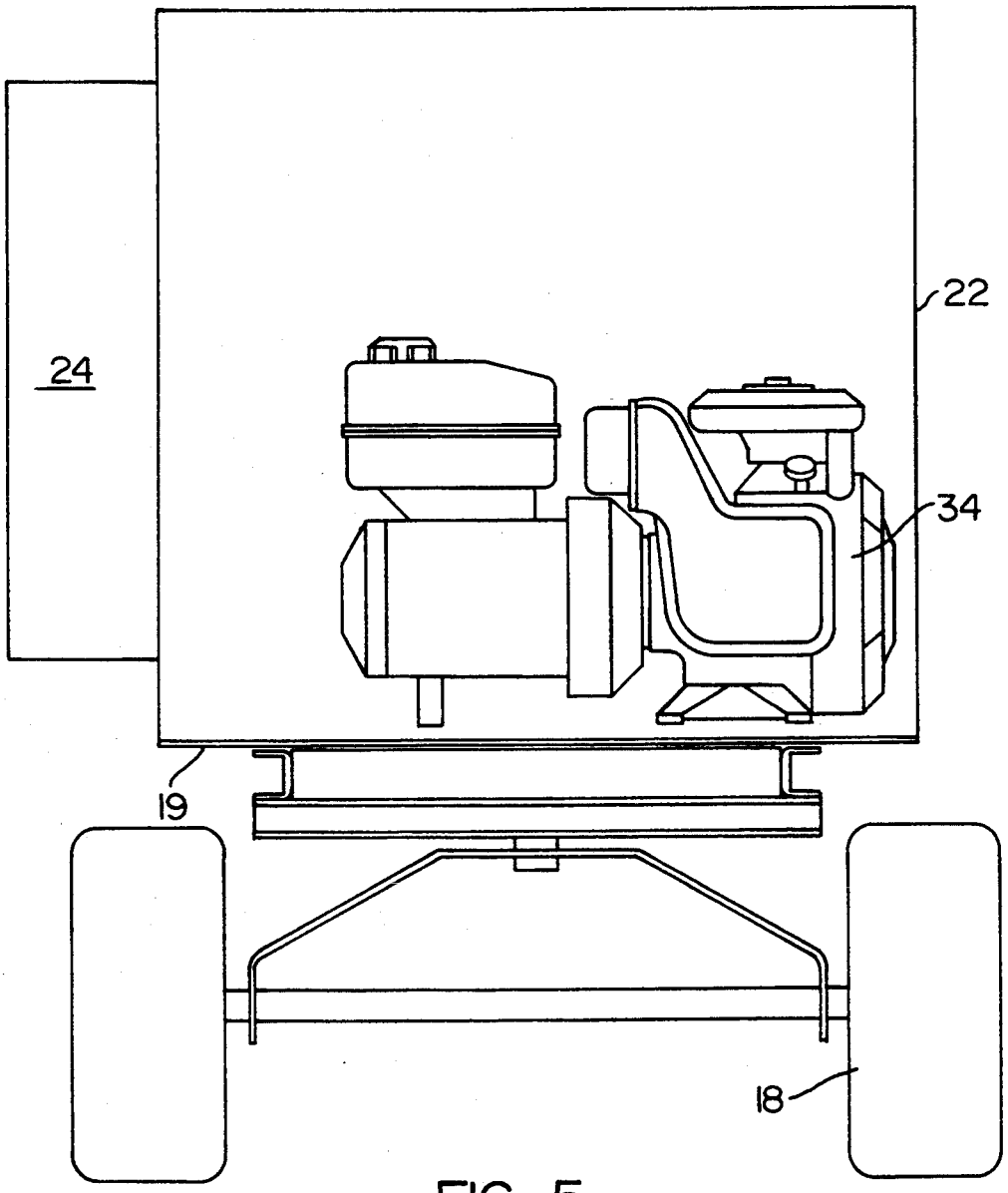
FIG. 5 is an enlarged front elevation showing the interior of the device of FIG. 1, the front diamond vent face of the outer shell and all hose reels having been removed.
Figure 6:
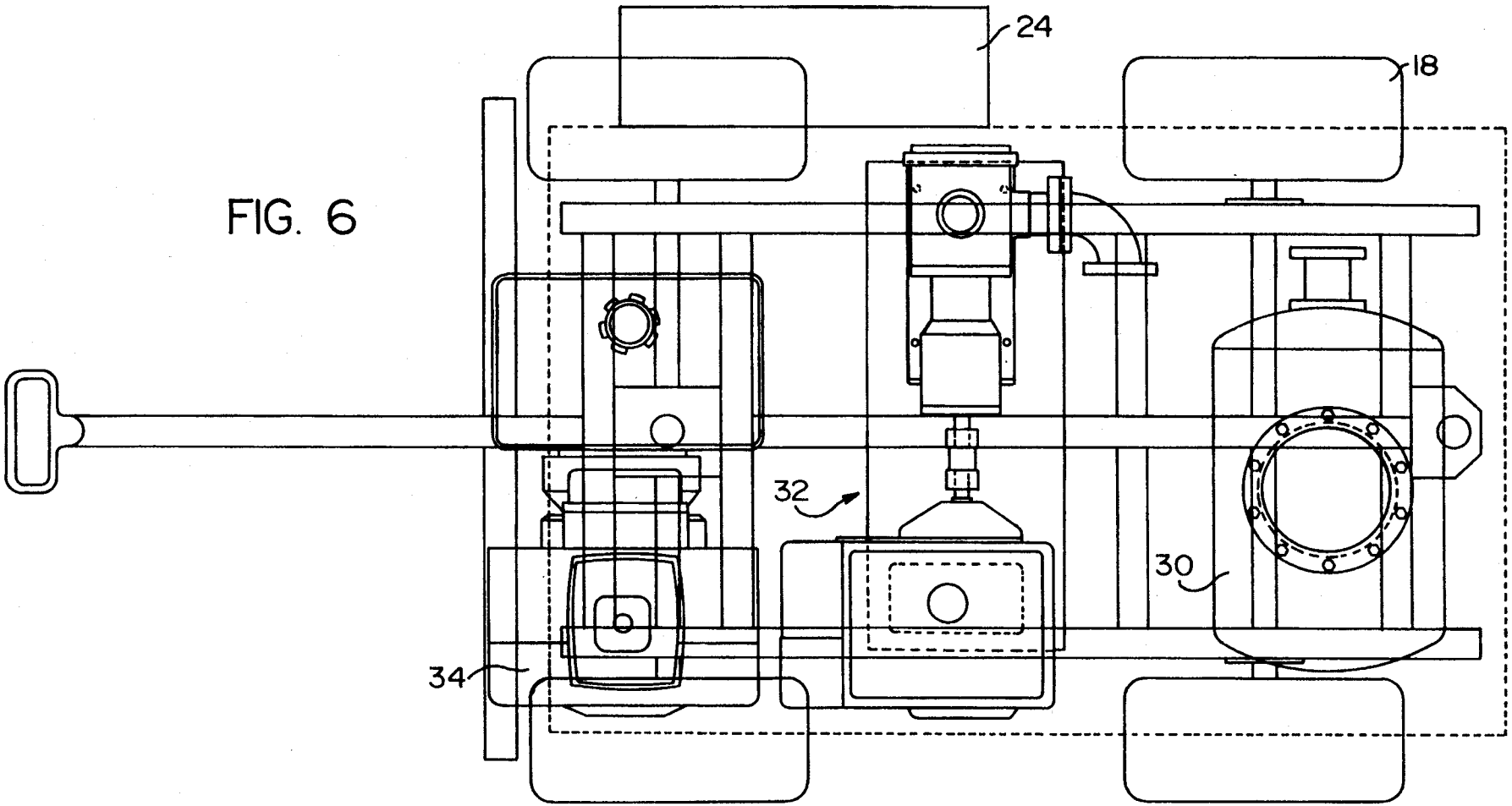
FIG. 6 is an enlarged top view showing the interior of the device of FIG. 1, the top face of the outer shell and all hose reels having been removed.

With the outer right face removed, FIG. 3 shows a right side view of the interior of the device. From the front of the device to the back, there is arranged an electric generator 34, a pump assembly 32, and a fifteen gallon storage tank 30. During use, the electric generator 34 and the pump assembly 32 receive a sufficient flow of air through the diamond vent screen 23 covering the front end of the machine. FIG. 4A gives a rear view of the outer configuration of the device illustrating the pliable hoses 36 wrapped around the reels 28. FIGS. 4B and 5 respectively show the interior of the device as seen from the rear and the front, thereby depicting the storage tank 30 and electric generator 34. FIG. 6 is a top section view of the hot asphalt device, further illustrating the arrangement of the electric generator 34, the pump assembly 32, and the storage tank 30.

Figure 7A:
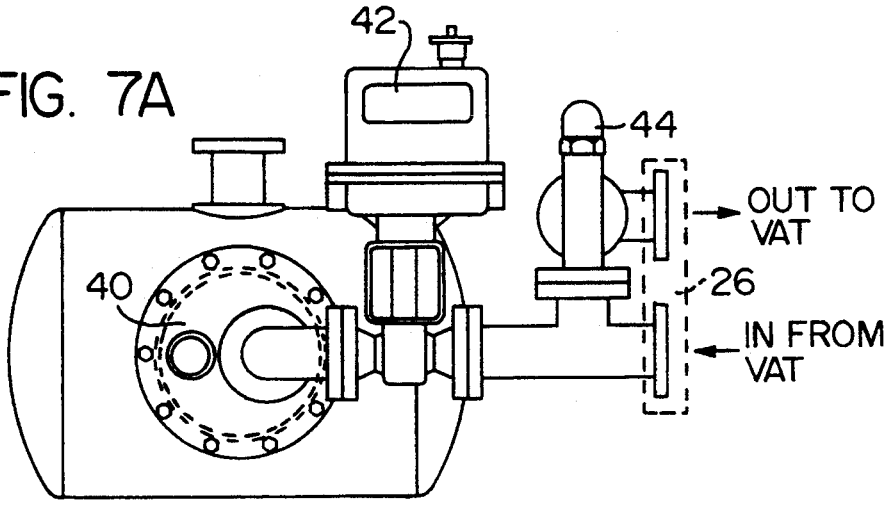
FIG. 7A is an enlarged top view of the storage tank assembly of the device of FIG. 1.
Figure 7B:
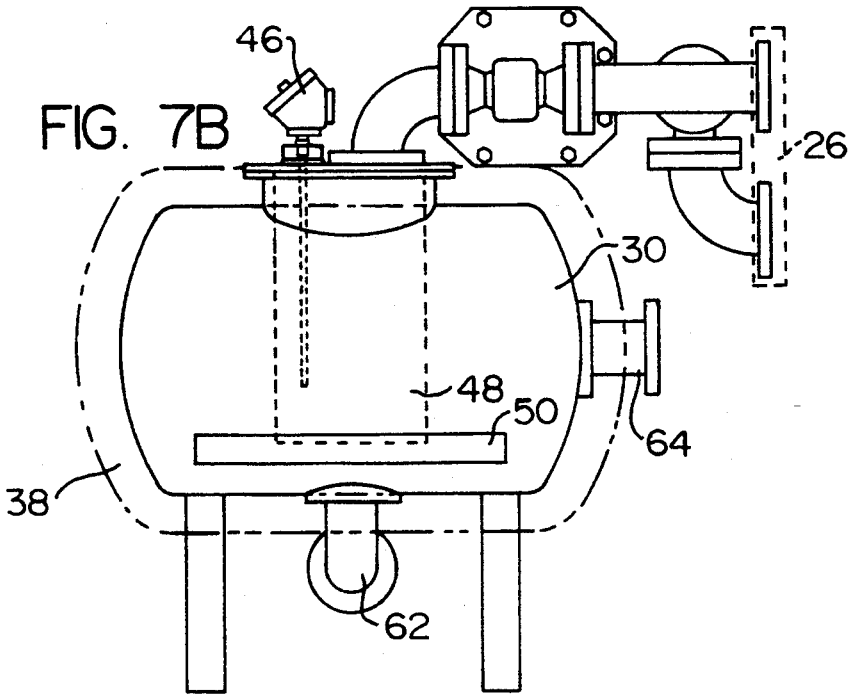
FIG. 7B is an enlarged rear elevation, partially sectioned, of the storage tank assembly of the device of FIG. 1.

The storage tank 30 and its constituent parts are better seen in FIGS. 7A and 7B. Holding roughly fifteen gallons of molten asphaltic material, the storage tank 30 has a number of heating elements 50 disposed in its inner cavity. Although roughly twenty to thirty heater elements 50 are provided in the tank 30, the exact number will depend on the degree of heating required to keep the asphalt in a liquified form. The temperature within the tank 30, measured with a thermocouple 46 extending into the storage tank 30 through the tank cap 40, is regulated via the control panel 24. In circulating through the storage tank 30, the hot asphalt material is made to pass through a filter 48 to remove any solid debris. The storage tank 30 itself is surrounded by an insulating jacket 38 in order to prevent excessive heat loss to the surroundings.

In order to keep the contained supply of hot asphalt in a sufficiently heated and readily spreadable form during operation of the device, the storage tank 30 is in constant communication with an outside supply of material contained in a tanker or kettle. Pump means located on the external, central supply forces the asphaltic material to enter the storage tank 30 through the storage tank manifold 26, through a ball valve 42, and finally, through the tank cap 40. The opposite order holds true for material being circulated from the storage tank 30 to a central supply outside the device. A relief valve 44 is included on the pipe system connecting the storage tank 30 to the storage tank manifold 26.

Proper material level within the storage tank 30 is maintained by means of a float device (not shown) and the ball valve 42 which actuates when the level of asphaltic material within the tank 30 decreases. As material is circulated from the storage tank 30 to an external supply source, the float device sinks and causes the ball valve 42 to open and allow new material to be pumped into the tank 30. As the material level increases, the float rises and the ball valve 42 closes just as the proper level is reached. The ball valve 32 and float perform the very same level control function as material is applied to roof surfaces. That is, as the material is withdrawn into the pump assembly 32 on its way to being applied, the level within the storage tank 30 decreases, thereby opening the ball valve 32 and allowing new material to enter the tank 30 from the external supply.

The storage tank 30 communicates with the pump assembly 32 through lower discharge port 62 and side intake port 64. Material being circulated to an applicational area leaves the storage tank 30 through lower discharge port 62, while material being pumped from the pump assembly 32 through the tank 30 enters the tank 30 through side intake port 64.

Figure 8A:
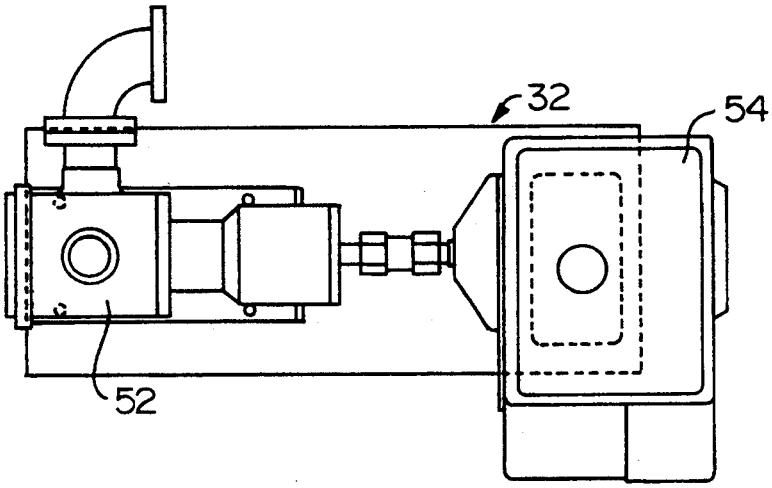
FIG. 8A is an enlarged top view of the pump assembly of the device of FIG. 1.
Figure 8B:
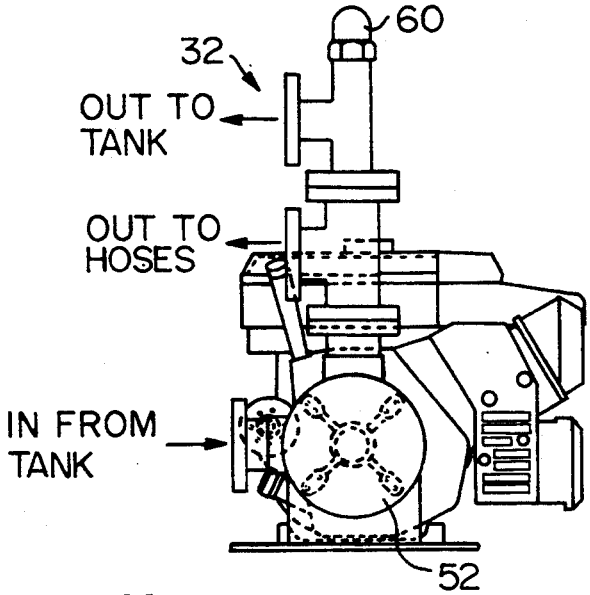
FIG. 8B is an enlarged left side elevation of the pump assembly of the device of FIG. 1.
Figure 8C:
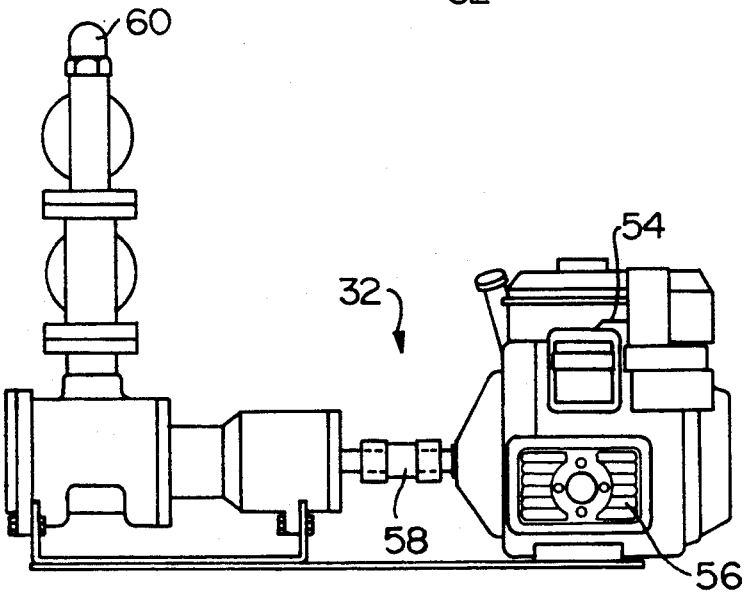
FIG. 8C is an enlarged front elevation of the pump assembly of the device of FIG. 1.

The pump assembly 32 is seen in great detail in FIGS. 8A through 8C. The pump assembly 32 comprises a motor 54 having a base plate 56, a coupling 58, and a gear pump 52. The motor 54, which produces approximately ten horsepower, transmits rotational power through the coupling 58 to the pump 52 which then circulates the asphaltic material through the storage tank 30 and out to an applicational area through the pliable hoses 36. A relief valve 60 is included on the pump manifold assembly.

Hot asphalt flow outside of the central device, whether it be circulating to the central material supply or pumping to an application zone, takes place through the pliable hoses 36. Three lengths of these hoses 36, wrapped around reel mechanisms 28, are connected at each of their first ends to the pump assembly 32 for communication with the pressurized material. Hand held applicator devices are attached to these hoses 36 at their terminal ends for applying the hot asphalt to a surface.

During operation of the device, two other flexible hoses 36 are connected to the hot asphalt device through storage tank manifold 26. These two hoses 36, identical in construction to the three hoses 36 previously mentioned, are both joined at their terminal ends to the central hot asphalt supply. While the three hoses 36 wrapped onto the reels 28 assist in applying the asphaltic material to a roof surface, the two hoses 36 connected to the storage tank manifold 26 circulate the hot asphalt from the storage tank 30 to the central material supply in the tanker or kettle. Since these two pliable hoses 36 will always rest side-by-side during operation of the device, they may be integrated into a combined double-line having two separate tubular passageways. However, the overall construction of this integrated double-line would remain the same as that of the individual hoses 36.

Figure 9A:
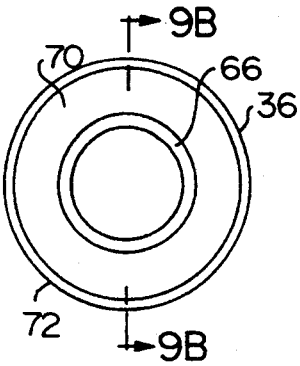
FIG. 9A is a section through a hose of the device of FIG. 1, much enlarged, and cutting the central longitudinal axis of the hose at a right angle.

The construction of the hoses 36, shown in FIGS. 9A through 9F, is one of the most critical aspects in the successful operation of the instant invention. FIG. 9A is a cross-section through the width of a preferred hose 36, cutting its central longitudinal axis at a right angle. The hose 36 has a stainless steel braided shell 66 which forms the inner, hollow passageway through which the asphaltic material may flow. Wrapped around this shell 66 is an electrically conductive heating wire 68, seen in FIG. 9B. Surrounding the stainless steel braided shell 66 and heating wire 68 is an insulating Silicone cloth portion 70, itself wrapped with a final layer of insulating rubber 72. FIG. 913 is a section through line AA of the hose of FIG. 9A, further illustrating the interior portion. The electrically conductive wire 68 seen in this figure is wrapped around the inner stainless steel braided shell 66 in a spiral configuration along the entire length of the hose 36. Lateral spacing of each successive coil of the conductive wire 68 depends on the degree of heating required within the stainless steel braided shell 66.

The stainless steel braided shell 66 serves multiple purposes. Its flexible yet strong design will permit the hose 36 to be manipulated about during application of the asphalt without danger of line rupture. Since stainless steel is virtually non-corrosive, the line will stay clean and clear during operation of the device. Also, the stainless steel shell 66 will serve as an excellent heat exchange medium between the heating wires 68 and the asphalt material so as to keep the latter in a liquid state while it is contained within the hose 36. The Silicone and rubber layers 70 and 72 will insulate the heating wire 68 and stainless steel braided shell 66 to the degree that a person will be able to grasp the hose 36 without danger of being burned.

Figure 9B:
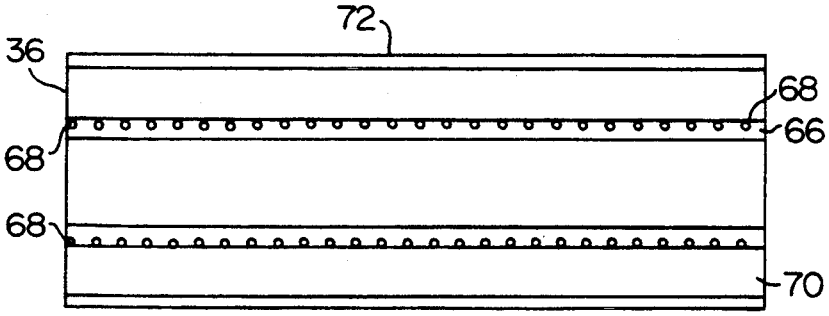
FIG. 9B is a section through line AA of the hose of FIG. 9A.
Figure 9C:
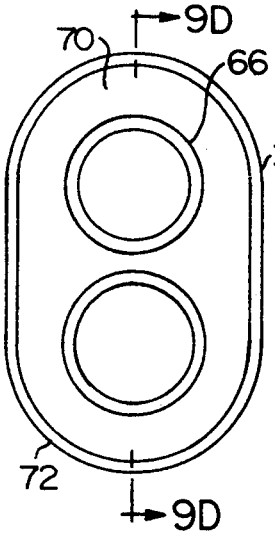
FIG. 9C is a section through an integrated double-line hose of the device of FIG. 1, much enlarged, and cutting the central longitudinal axis of the hose at a right angle.
Figure 9D:
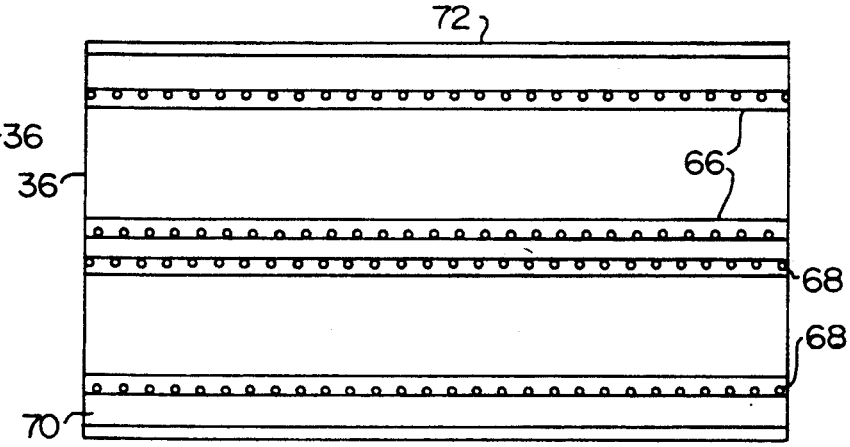
FIG. 9D is a section through line BB of the hose of FIG. 9C.

FIG. 9C is a cross-section through the width of the integrated double-line hose 36 previously mentioned, also cutting the central longitudinal axis at a right angle. Two stainless steel braided shell men, bets 66 give this hose an oblong appearance. FIG. 9D is a section through line BB of the hose of FIG. 9C, illustrating how each of the stainless steel braided shell members 66 has an electrically conductive heating wire 68 wrapped around its outer length. Apart from having two inner stainless steel braided shell men, bets 66, the overall construction shown is the same as the hose 36 of FIGS. 9A and 9B.

The integrated double-line hose shown in FIGS. 9C and 9D is meant to be joined to the storage tank manifold 26 and the central kettle supply. One of the stainless steel braided shells 66 will serve as an intake passage guiding material to the storage tank 30, while the other will serve as a discharge passage guiding asphalt material to the kettle supply. Heating of the stainless steel braided shell members 66 will be sufficient to keep the asphaltic material liquified during circulation.

Figure 9E:
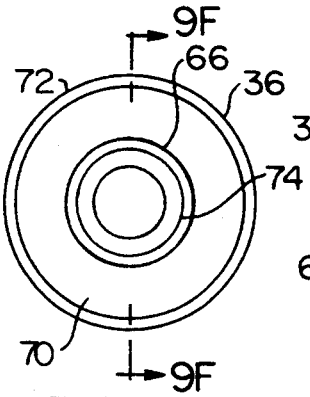
FIG. 9E is a section through a hose of the device of FIG. 1, much enlarged, and cutting the central longitudinal axis of the hose at a right angle.
Figure 9F:
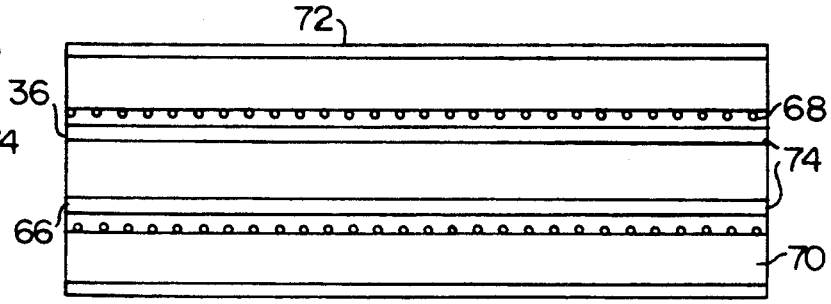
FIG. 9F is a section through line CC of the hose of FIG. 9E.
Figure 10:
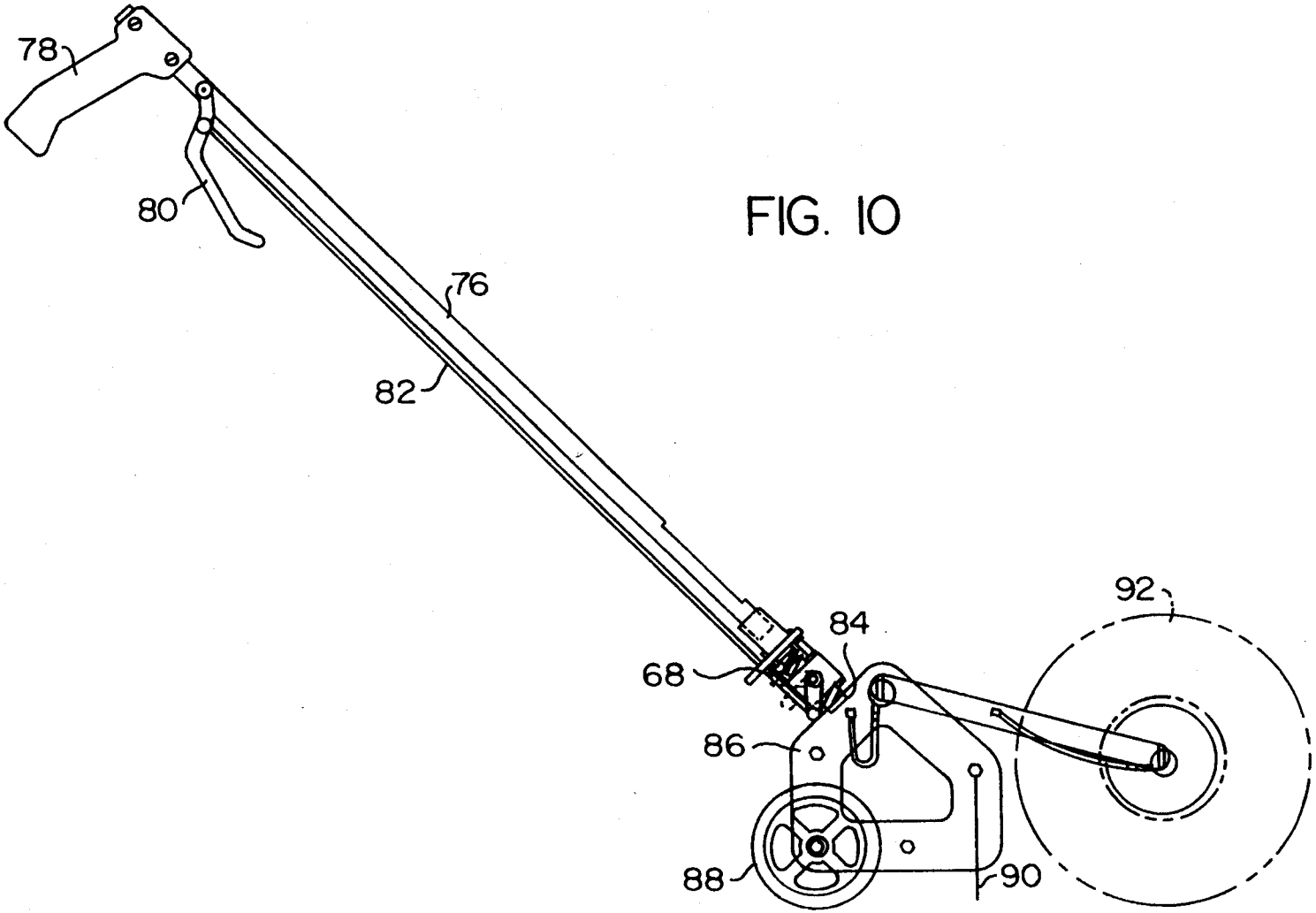
FIG. 10 is a side elevation of a rollable hand-held applicator used in conjunction with the device of FIG. 1, the applicator complete with an optional roller attachment.

FIGS. 9E and 9F show the hose 36 of FIGS. 9A and 9B with the addition of a Teflon coating 74 on the inside of the stainless steel braided shell 66. The Teflon interior 74 will assist in the transfer of the hot asphalt through the hose 36, while adding to the strength and stability of the line.

It is crucial to keep the asphalt material in a liquified form during operation of the device. In other words, the asphalt will need to be heated from the time it leaves the central kettle or tanker supply until it is either applied to a roof surface or returned to the central supply. Towards this end, the present invention proposes two independent heating mechanisms: the first being the electrically conductive wires 68 wrapped along the interior of the hoses 36, and the second being the heating elements 50 contained within the storage tank 30. As the material exits the central supply, it is heated by the conductive wires 68 as it travels through the hose 36 on its way to the storage tank 30. The same holds true for material being circulated from the tank 30 to the outside kettle supply. While the material rests within the storage tank 30, it is heated by the heating elements 50 therein contained. The material that is pumped out to an application zone is also heated as it travels through the stainless steel braided shell 66 wrapped with the electrically conductive wires 68. Both the electrically conductive heating wires 68 in the hoses 36 and the heating elements 50 contained within the storage tank 30 receive electric current from the electric generator 34.

In order to produce sufficient current through the wires 65 and elements 50, it is estimated that the generator 34 will need to produce nine thousand watts of electricity. However, the size and capacity of the generator may need to be increased or decreased, depending on the length of the heating wires 68, the number of heating elements 50, and the weather conditions during operation.

Application of the hot asphalt begins at the terminal ends of the hoses 36 leading from the reels 28, where they are joined to one of two hand-held applicator devices. The first, seen in FIG. 10, comprises a rigid tube member 76 joined to a base frame assembly 86. A number of asphalt jet nozzles 84 are evenly spaced just below the rigid tube member 76 in order to provide a uniform and uninterrupted asphalt spray through the hollow portion of the base frame 86 and onto a surface. Preferably, four nozzles 84 each spraying a ten inch wide stream of asphalt are employed on the base frame 86. Taking into account spray overlap, this latter arrangement will result in a thirty-six inch wide asphalt application per pass. In order to prevent clogging during asphalt spray, a heating wire 68 is wrapped around each of the jet nozzles 84.

A hose 36 (not seen in FIG. 10), running parallel and juxtaposed next to the rigid tube member 76, attaches to the nozzles 84 adjacent the lower end of the rigid tube 76. The asphalt jet nozzles 84 are opened when the hand trigger 80 is pivoted into the stationary handle 78, thereby actuating the nozzle engagement rod 82. The hand trigger 80 is biased to a closed position when no pressure is applied. The base frame 86 of the applicator device is mounted on wheels 88. At the rear end of the base frame 86, there is a strip of yarn 90 spanning the entire width of the applicator device and running parallel to the arrangement of jet nozzles 84. In order to evenly spread any newly ejected asphalt sprayed from the jet nozzles 84 onto the roof, the yarn strip 90 drags on the surface and runs over the asphalt as the device is rolled backwards. A roller attachment 92 detachably connected to the base frame 86 of the device may be incorporated in order to better spread the asphaltic material on the roof surface.

Figure 11A:
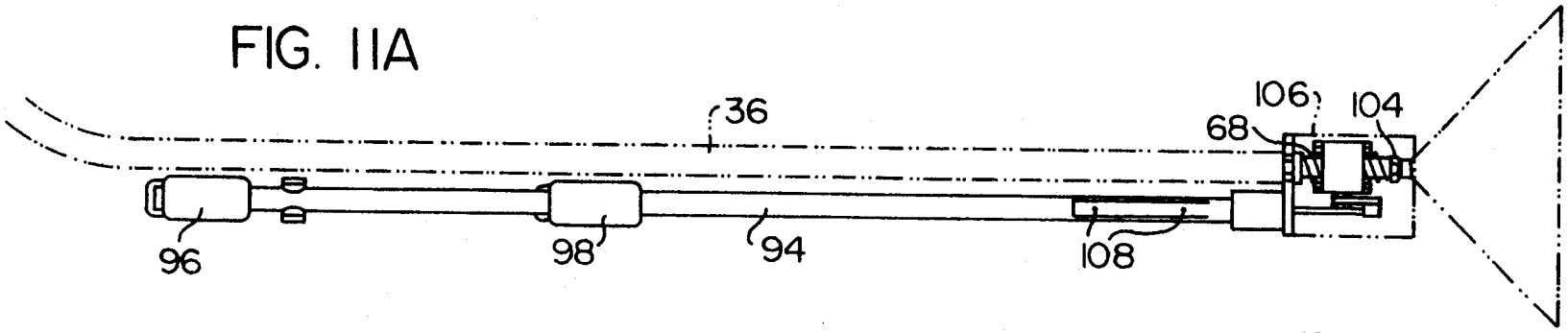
FIG. 11A is a top view of a hand-held spray gun applicator used in conjunction with the device of FIG. 1.
Figure 11B:
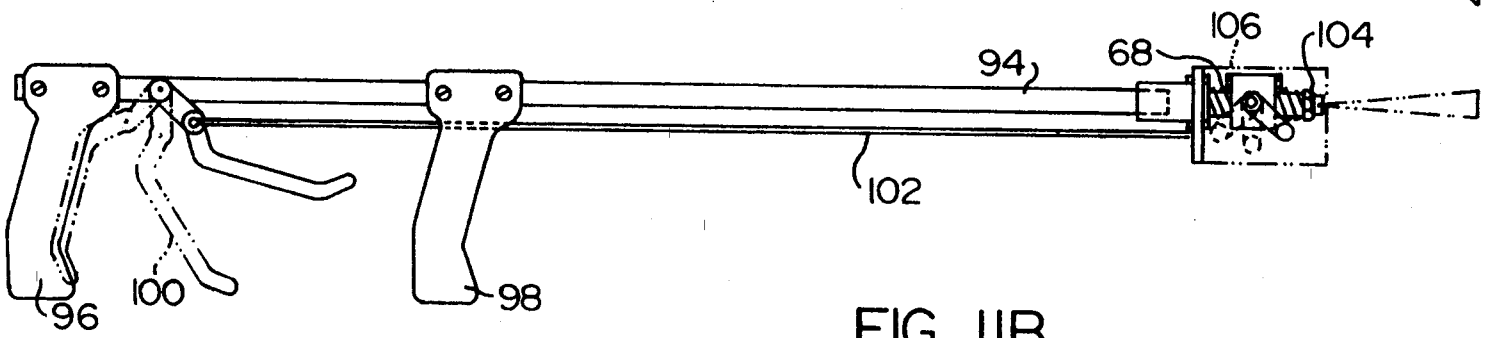
FIG. 11B is a side elevation of the hand-held spray gun applicator of FIG. 11A.

The second hand-held applicator device, an asphalt spray gun, is first shown in FIGS. 11A and 11B. This spray gun is similar to the first applicator device except that it has no base frame and uses only one asphalt jet nozzle 104. The combination of a forward adjustable handle 98 and a rear stationary handle 96 allows a user to comfortably lift the gun and spray asphalt onto a number of narrow, irregular, and/or discontinuous surfaces not accessible with the first applicator device. As seen in FIG. 11A, the hose 36 attaches to the jet nozzle 104 next to the lower end of the rigid tube member 94. As with the first applicator device, the spray gun nozzle 104 is wrapped with a heating wire 68 for keeping the asphalt material passing through the nozzle 104 in a sprayable and liquified form. In order to safeguard against burn injury, a heat shield 106 is placed around the nozzle 104. Two mounting holes 108 for an optional attachment are provided on the rigid tube 94.

Asphalt spray through the gun commences when the hand trigger 100 is pivoted backwards in order to slide the nozzle engagement rod 102 and open the nozzle 104. Holding the spray gun tire inches from a fiat surface and pulling the hand trigger 100 will produce a ten to twelve inch wide uniform stream of hot asphalt spray from the nozzle 104.

Figure 12A:
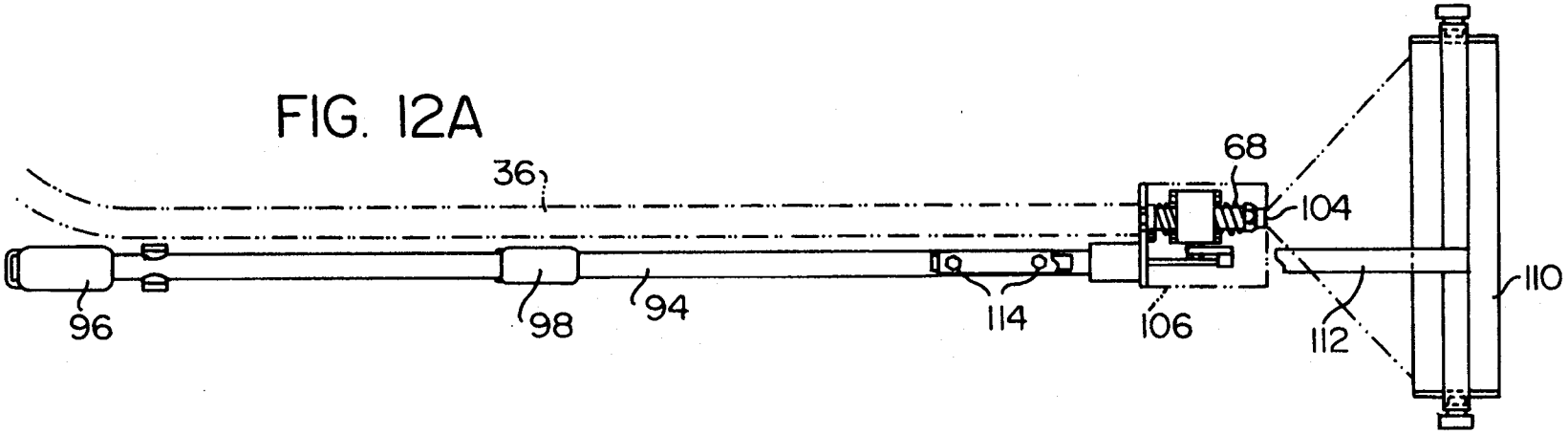
FIG. 12A is a top view of the hand-held spray gun applicator of FIG. 11A, the spray gun complete with an optional padded-nap roller attachment.
Figure 12B:
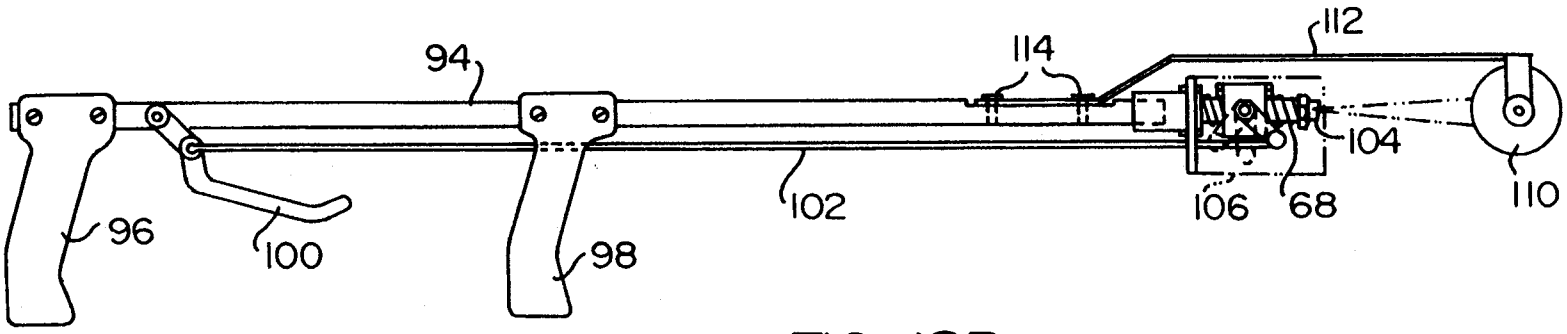
FIG. 12B is a side elevation of the hand-held spray gun applicator of FIG. 11A, the spray gun complete with an optional padded-nap roller attachment.

FIGS. 12A and 12B show the spray gun complete with a padded-nap roller attachment 110. The roller attachment 110 is secured to the rigid tube member 94 of the spray gun via two mounting bolts 114 and a mounting bracket 112. Operation of the spray gun with the roller attachment 110 results in an even stream of asphalt being discharged directly onto the padded nap 110. In this manner, the padded nap 110 may be rolled onto a surface as the jet nozzle 104 is actuated by the hand trigger 100 for a roller type of application of the hot asphalt material onto a surface.

A number of additional features may be added to the hot asphalt transfer and application device thus far described. For example, an air compressor (not shown in the figures) may be included on the hot asphalt device for blowing-out the lines after the machine is finished a job. Also, an independent motor drive system may be incorporated in the cart assembly 16 for helping to move the device about once it is positioned on a roof.

Figure 13:
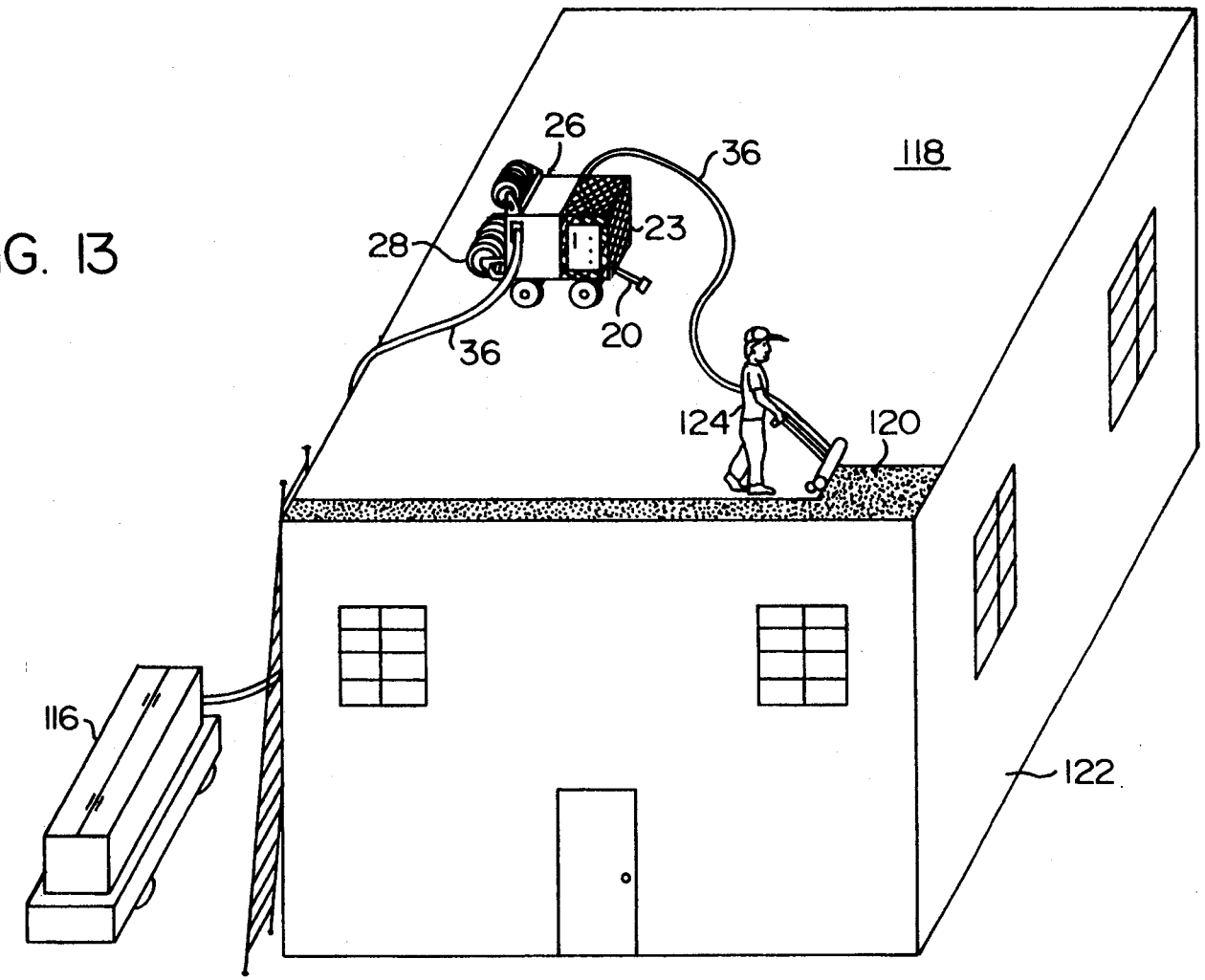
FIG. 13 is a perspective view of a typical roofing application using the device of FIG. 1.

The general operation of the hot asphalt device will now be described with the assistance of FIG. 13 which illustrates a typical roofing application. The hot asphalt device in FIG. 13 is seen resting on the roof surface 118 of a relatively small sized building 122. As the machine weighs over one thousand pounds, a crane is used to raise the device. However, it will be noted that an alternate set-up would have the device resting on ground and the applicational hoses 36 extending upwards to their respective hand-held devices. This latter scheme is preferred when repairing exceptionally small and/or low roofs.

As illustrated in FIG. 13, a hose 36 connected to the storage tank manifold 26 and to a ground based kettle 116 allows hot asphalt to circulate from she kettle to the storage tank 30. This hose 36 takes on the construction of the aforementioned integrated double-line, and therefore has a first tubular passage that carries asphalt from the storage tank 30 to the kettle 116 and a second tubular passage that carries asphalt from the kettle 116 to the tank 30.

One worker 124 is seen applying a thin and uniform layer of hot asphalt 120 onto the roof 118 using the first mentioned applicator device, the roller attachment 92 not having been included. The worker 124 simply rolls the applicator device backwards while he squeezes the hand trigger 80, and thereby automatically spreads a thirty-six inch wide layer of hot asphalt 120 onto the roof 118. The worker 124 is seen applying a second strip of hot asphalt 120 next to the first.

The transfer of the hot asphalt from the machine to the worker occurs through the hose 36 connected to the applicator device and to the pump assembly 32 on the machine. The hose 36 is wrapped on a reel mechanism 28 for easy retraction. Had the roof been larger, more people may have been shown working in the process. It will be appreciated that three people each drawing hot asphalt from a separate line and applying the hot asphalt through an applicator device (either the one shown or the spray gun) may simultaneously work from a single machine. Consequently, the hot asphalt machine is ideal for both small scale and larger applications requiring different numbers of workers.

Once work is finished, the excess material in the tank 30 and hoses 36 is returned to the kettle 116. Next, the hoses 36 may be blown completely clear with an air compressor. It is not, however, inoperative to clean the hoses 36 and the tank 30 thoroughly after every job since any residual material in the hoses 36 and tank 30 that hardens will liqudify when the machine is used next. The hoses 36 may then be retracted on the reels 28 and the machine stored until it is used for another application.

The automated system depicted in FIG. 13 has numerous advantages over conventional asphalt roofing methods. Since the hot asphalt is being automatically transferred to the point of application, danger of exposure to the hot asphalt has been minimized. The combination of the automatic transferral system and the two hand-held applicators, each of the latter having some sort of nozzle spray system, allows the worker to apply the hot asphalt continuously, speedily, and efficiently.

It should be clear that the present invention is not limited to the previous descriptions and drawings which merely illustrate the preferred embodiment thereof. Slight departures may be made within the present scope of the invention. For example, there may be four reels 28 rather than the three illustrated, and the hoses 36 may be contained within the shell 22 of the device. Accordingly, the scope of the invention is meant to embrace any and all equivalent apparatus as well as all design alterations as set forth in the appended claims.

What is claimed is:

1. A portable machine for transferring and applying molten asphaltic material to roofs or other surfaces, comprising:

a mobile structure defining the rigid framework of said machine;

an outer rectangular shell connected to said mobile structure and having a front and a back portion wherein the front portion of said outer rectangular shell is a mesh screen for the circulation of air therethrough;

electric power generation means located inside of said outer rectangular shell and attached to said structure;

a first heater means comprising a number of heating elements;

a second heater means comprising a number of electrically conductive heating wires, said first and second heating means both receiving electric current flow from said electric power generation means;

storage means for containing said asphaltic material, said storage means located inside said rectangular shell and attached to said structure, said storage means including automatic level control valve means comprised of a ball valve and float combination for regulating the amount of said asphaltic material contained therein, said first heater means disposed on the inner surface of said storage means; said storage means provided with insulating means;

insulated tube means for carrying and transferring said molten asphaltic material, said insulated tube means having an inner tube member wrapped with said second heater means, said insulated tube means connected to said storage means;

pump means, located inside said outer rectangular shell and external to said storage means and connected thereto by said insulated tube means, for circulating said asphaltic material through said insulated tube means;

a filter means disposed inside said storage means for filtering said asphaltic material;

applicator means comprising a number of hand-held devices for dispensing said asphaltic material, said applicator means connected to said insulated tube means; and a number of asphalt jet nozzles disposed on said applicator means, said asphalt jet nozzles connected to the terminal ends of said insulated tube means, said asphalt jet nozzles providing the discharge ports for said molten asphaltic material, said asphalt jet nozzles having said second heater means attached thereto.

2. A portable machine for transferring and applying molten asphaltic material to roofs or other surfaces as recited in claim 1, wherein said inner tube member of said insulated tube means is a stainless steel braided shell surrounding a Teflon interior, whereby said stainless steel braided shell is wrapped with said second heater means, wherein said second heater means is then covered with an insulating Silicone cloth, and whereby said Silicone cloth is coated with a layer of rubber.

3. A portable machine for transferring and applying molten asphaltic material to roofs or other surfaces as recited in claim 1, wherein said inner tube member of said insulated tube means is a stainless steel braided shell, whereby said stainless steel braided shell is wrapped with said second heater means, wherein said second heater means is then covered with an insulating cloth, and whereby said insulating cloth is coated with a layer of rubber.

4. A portable machine for transferring and applying molten asphaltic material to roofs or other surfaces as recited in claim 1, wherein said insulated tube means is connected on one of its respective ends to said storage means through said automatic level control valve means, and on the other of its respective ends to a central supply of said asphaltic material.

5. A portable machine for transferring and applying molten asphaltic material to roofs or other surfaces as recited in claim 1, whereby a number of separate lengths of said insulated tube means are each independently connected to said storage means and one of said applicator means, and retractably joined to a reel mechanism.

6. A portable machine for transferring and applying molten asphaltic material to roofs or other surfaces as recited in claim 1, wherein said mobile structure is rigidly joined to a number of axles journaled in and supported by a plurality of wheels.

7. A portable machine for transferring and applying molten asphaltic material to roofs or other surfaces as recited in claim 1, whereby pulling means is attached to said structure.

8. A portable machine for transferring and applying molten asphaltic material to roofs or other surfaces as recited in claim 1, wherein said applicator means comprises, in combination, a multiplicity of said asphalt jet nozzles arranged in a line, a straight length of yarn strips arranged essentially parallel to said asphalt jet nozzles, a rigid tube member juxtaposed next to the terminal portion of said insulated tube means, valve means for regulating the discharge of said asphaltic material, a hand manipulable trigger for opening and closing said valve means, and a lower base structure having a number of wheels attached thereto, wherein said rigid tube men,her is attached to said base structure, whereby said insulated tube means feeds said asphaltic material to said asphalt jet nozzles, wherein said asphalt jet nozzles spray an even amount of said asphaltic material onto a roof surface when actuated by said hand manipulable trigger, and whereby said length of yarn strips drags behind said asphalt jet nozzles and onto said roof surface so as to evenly spread the discharged quantity of said asphaltic material.

9. A portable machine for transferring and applying molten asphaltic material to roofs or other surfaces as recited in claim 8, wherein said applicator means further comprises a roller detachably connected to said lower base structure, and whereby said roller is arranged to roll behind said length of yarn strips in order to better spread the discharged quantity of said asphaltic material on said roof surface.

10. A portable machine for transferring and applying molten asphaltic material to roofs or other surfaces as recited in claim 1, wherein said applicator means comprises, in combination, a rigid tube member juxtaposed next to the terminal portion of said insulated tube means, one of said asphalt jet nozzles rigidly connected to the lower end of said insulated tube means, valve means for regulating the discharge of said asphaltic material through said asphalt jet nozzle, and a hand manipulable trigger for opening and closing said valve means, whereby said asphalt jet muzzle sprays a uniform layer of said asphaltic material onto a surface when actuated by said hand manipulable trigger.

11. A portable machine for transferring and applying molten asphaltic material to roofs or other suffices as recited in claim 10, wherein said applicator means further comprises a padded roller attachment, whereby said padded roller attachment is detachably connected to the lower portion of said rigid tube member and is thereby disposed immediately under said asphalt jet nozzle, wherein said padded roller attachment has a padded nap on its outer surface, and whereby hot asphaltic material discharges from said asphalt jet nozzle and onto said padded nap just before it is applied to said surface.

12. A portable machine for transferring and applying molten asphaltic material to roofs or other surfaces, comprising:

rigid structure defining the metal framework of said machine and supported by a plurality of wheels;

an outer rectangular shell having a front portion and a back portion, wherein said front portion is a mesh screen for the circulation of air therethrough;

electric power generation means located inside of said outer rectangular shell and attached to said structure;

a first heater means comprising a number of heating elements;

a second heater means comprising a number of electrically conductive heating wires, said first and second heater means both receiving electric current flow from said electric power generation means;

a refillable insulated container having an inner cavity for holding said asphaltic material, said refillable insulated container located inside of said outer rectangular shell and attached to said structure, said refillable insulated container having automatic level control valve means comprised of a ball valve and float combination for regulating the amount of said asphaltic material therein contained, the interior cavity of said refillable insulated container surrounded by said first heater means;

a filter means located inside of said refillable insulated container for filtering said asphaltic material;

pliable tube means for carrying and transferring said molten asphaltic material, said pliable tube means having an inner tube member wrapped with said second heater means, said pliable tube means connected to said storage means, said pliable tube means having insulation wrapped therearound;

a hydraulic pump means for circulating said asphaltic material through said pliable tube means, said hydraulic pump means being driven by a motor, said hydraulic pump means located inside of said outer rectangular shell means and attached to said structure;

applicator means comprising a number of hand-held devices for dispensing said asphaltic material, said applicator means connected to said pliable tube means; and a number of asphalt jet nozzles disposed on said applicator means, said asphalt jet nozzles connected to the terminal ends of said pliable tube means, said asphalt jet nozzles providing the discharge ports for said molten asphaltic material, said asphalt jet nozzles having said second heater means wrapped therearound.

13. A portable machine for transferring and applying molten asphaltic material to roofs or other surfaces as recited in claim 12, wherein said inner tube member of said pliable tube means is a stainless steel braided shell, whereby said stainless steel braided shell is wrapped with said second heater means, wherein said second heater means is then covered with an insulating cloth, and whereby said insulating cloth is coated with a layer of rubber.

14. A portable machine for transferring and applying molten asphaltic material to roofs or other surfaces as recited in claim 12, whereby a number of separate lengths of said pliable tube means are each independently connected to said refillable insulated container and to one of said applicator means, and retractably wrapped around a reel mechanism.

15. A portable machine for transferring and applying molten asphaltic material to roofs or other surfaces as recited in claim 12, wherein a pulling arm is attached to said structure.

16. A portable machine for transferring and applying molten asphaltic material to roofs or other surfaces as recited in claim 12, wherein said applicator means comprises the combination of a multiplicity of said asphalt jet nozzles arranged in a line, a straight length of yarn strips arranged essentially parallel to said asphalt jet nozzles, a rigid tube member running parallel to the terminal portion of said pliable tube means, valve means for regulating the discharge of said asphaltic material, a hand manipulable trigger for opening and closing said valve means, and a lower base structure having a number of wheels attached thereto, wherein said rigid tube member is attached to said base structure, whereby said pliable tube means feeds said asphaltic material to said asphalt jet nozzles, wherein said asphalt jet nozzles spray an even amount of said asphaltic material onto a roof surface when actuated by said hand manipulable trigger, and whereby said length of yarn strips drags behind said asphalt jet nozzles and onto said roof surface so as to evenly spread the discharged quantity of said asphaltic material.

17. A portable machine for transferring and applying molten asphaltic material to roofs or other surfaces as recited in claim 16, wherein said applicator means further comprises a roller detachably connected to said lower base structure, and whereby said roller is arranged to roll behind said length of yarn strips in order to better spread the discharged quantity of said asphaltic material onto said roof surface.

18. A portable machine for transferring and applying molten asphaltic material to roofs or other surfaces as recited in claim 12, wherein said applicator means comprises the combination of a rigid tube men, bet running parallel to the terminal portion of said pliable tube means, one of said asphalt jet nozzles rigidly connected to the lower end of said pliable tube means, valve means for regulating the discharge of said asphaltic material through said asphalt jet nozzle, and a hand manipulable trigger for opening and closing said valve means, whereby said asphalt jet nozzle sprays a uniform layer of said asphaltic material onto a surface when actuated by said hand manipulable trigger.

19. A portable machine for transferring and applying molten asphaltic material to roofs or other surfaces as recited in claim 18, wherein said applicator means further comprises a padded roller attachment, whereby said padded roller attachment is detachably connected to the lower portion of said rigid tube member and is thereby disposed immediately under said asphalt jet nozzle, wherein said padded roller attachment has a padded nap on its outer surface, and whereby hot asphaltic material discharges from said asphalt jet nozzle and onto said padded nap just before it is applied to said surface.

20. A portable machine for transferring and applying molten asphaltic material to roofs or other surfaces as recited in claim 12, wherein said refillable insulated container holds roughly fifteen gallons of said molten asphaltic material and keeps it in a liquified state via said first heater means until it is circulated through said pliable tube means, and whereby the portion of said asphaltic material running through said pliable tube means on its way to said applicator means is heated by said second heater means as it traverses the length of said pliable tube means and as it is discharged through said applicator means.

* * * * *

UNITED STATES PATENT AND TRADEMARK OFFICE

CERTIFICATE OF CORRECTION

PATENT NO. : 5,366,308

DATED : 11/22/94

INVENTOR(S) : Louis T. Crispino

It is certified that error appears in the above-indentified patent and that said Letters Patent is hereby corrected as shown below:

Col. 1, line 31, delete "drunks", insert --drums--;

Col. 1, line 33, delete "5,120,2,17", insert --5,120,217--;

Col. 1, line 64, delete "tinge", insert --time--;

Col. 1, line 68, delete "tinge", insert --time--;

Col. 2, line 57, delete "tinge", insert --time--;

Col. 2, line 64, delete "in, possible", insert --impossible--;

Col. 3, line 38, delete "rooting", insert --roofing--;

Col. 4, line 10, delete "fight", insert --right--;

Col. 7, line 13, delete "913", insert --9B--;

Col. 7, line 39, delete "men, bets", insert --members--;

Col. 7, line 45, delete "men, bets", insert --members--;

UNITED STATES PATENT AND TRADEMARK OFFICE

CERTIFICATE OF CORRECTION

PATENT NO. : 5,366,308

DATED : 11/22/94

INVENTOR(S) : Louis T. Crispino

It is certified that error appears in the above-indentified patent and that said Letters Patent is hereby corrected as shown below:

Col. 9, line 14, delete "tire", insert --five--, delete "fiat", insert --flat--;

Col. 9, line 51, delete "she", insert --the--;

Col. 14, line 28, delete "men, bet", and insert --member--.

Signed and Sealed this

Twenty-eighth Day of November 1995

*Attest:*

*Attesting Officer*

Bruce Lehman

BRUCE LEHMAN

*Commissioner of Patents and Trademarks*